US006457712B1

(12) United States Patent
Curling

(10) Patent No.: US 6,457,712 B1
(45) Date of Patent: Oct. 1, 2002

(54) PUZZLE PIECE DISPLAYING APPARATUS

(76) Inventor: Gay E. C. Curling, 44 Stroud Road, Wimbledon Park London SW19 8DG (GB)

( * ) Notice: Subject to any disclaimer, the term of this patent is extended or adjusted under 35 U.S.C. 154(b) by 4 days.

(21) Appl. No.: 09/636,601

(22) Filed: Aug. 11, 2000

(51) Int. Cl.[7] ..... A63F 9/10

(52) U.S. Cl. ..... 273/157 R; 273/237; 108/50.02; 40/484

(58) Field of Search ..... 273/157 R, 280; 40/484, 493, 503

(56) References Cited

U.S. PATENT DOCUMENTS

| | | | | |
|---|---|---|---|---|
| 157,945 | A | * | 12/1874 | Thomas |
| 451,956 | A | * | 5/1891 | Sandrson |
| 497,726 | A | | 5/1893 | Phelps |
| 697,377 | A | * | 4/1902 | Maxwell |
| 716,367 | A | * | 12/1902 | Bekker |
| 1,475,041 | A | * | 11/1923 | Alstott |
| D151,562 | S | | 10/1948 | Southwell |
| 3,359,003 | A | * | 12/1967 | Kass |
| 3,947,987 | A | * | 4/1976 | Allen |
| 4,026,559 | A | | 5/1977 | Carlton |
| 4,037,846 | A | * | 7/1977 | Zeeman |
| 4,206,922 | A | | 6/1980 | Keane |
| 4,552,362 | A | * | 11/1985 | Oake |
| 5,273,289 | A | | 12/1993 | Morse |
| 5,309,657 | A | * | 5/1994 | Spencer |
| 5,351,957 | A | * | 10/1994 | Scott |
| 5,651,547 | A | | 7/1997 | Rannelli |
| 5,785,320 | A | * | 7/1998 | Borg |
| 5,840,377 | A | * | 11/1998 | Donnell |

* cited by examiner

*Primary Examiner*—Paul T. Sewell
*Assistant Examiner*—Nini F. Legesse

(57) ABSTRACT

A puzzle piece displaying apparatus for displaying a plurality of puzzle pieces for facilitating assembly of the pieces. The puzzle piece displaying apparatus includes a pair of upstanding leg assemblies and a rotating assembly for holding a plurality of puzzle pieces. The rotating assembly comprises a plurality of plates for removably securing a plurality of pieces to the plates. A frame supports the plates. The frame includes an end member, a shaft, at least one support member and a plurality of mounting members.

1 Claim, 2 Drawing Sheets

PUZZLE PIECE DISPLAYING APPARATUS

BACKGROUND OF THE INVENTION

1. Field of the Invention

The present invention relates to puzzle piece displays and more particularly pertains to a new puzzle piece displaying apparatus for displaying a plurality of puzzle pieces for facilitating assembly of the pieces.

2. Description of the Prior Art

The use of puzzle piece displays is known in the prior art. More specifically, puzzle piece displays heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 497,726; U.S. Pat. No. Des. 151,562; U.S. Pat. No. 4,206,922; U.S. Pat. No. 5,273,289; U.S. Pat. No. 4,026,559; and U.S. Pat. No. 5,651,547.

While these devices fulfill their respective, particular objectives and requirements, the aforementioned patents do not disclose a new puzzle piece displaying apparatus. The inventive device includes a pair of upstanding leg assemblies and a rotating assembly for holding a plurality of puzzle pieces. A plurality of plates is for removably securing a plurality of pieces to the plates.

A frame supports the plates. The frame includes an end member, a shaft, at least one support member and a plurality of mounting members.

In these respects, the puzzle piece displaying apparatus according to the present invention substantially departs from the conventional concepts and designs of the prior art, and in so doing provides an apparatus primarily developed for the purpose of displaying a plurality of puzzle pieces for facilitating assembly of the pieces.

SUMMARY OF THE INVENTION

In view of the foregoing disadvantages inherent in the known types of puzzle piece displays now present in the prior art, the present invention provides a new puzzle piece displaying apparatus construction wherein the same can be utilized for displaying a plurality of puzzle pieces for facilitating assembly of the pieces.

The general purpose of the present invention, which will be described subsequently in greater detail, is to provide a new puzzle piece displaying apparatus apparatus and method which has many of the advantages of the puzzle piece displays mentioned heretofore and many novel features that result in a new puzzle piece displaying apparatus which is not anticipated, rendered obvious, suggested, or even implied by any of the prior art puzzle piece displays, either alone or in any combination thereof.

To attain this, the present invention generally comprises a pair of upstanding leg assemblies and a rotating assembly for holding a plurality of puzzle pieces. A plurality of plates is for removably securing a plurality of pieces to the plates. A frame supports the plates. The frame includes an end member, a shaft, at least one support member and a plurality of mounting members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new puzzle piece displaying apparatus apparatus and method which has many of the advantages of the puzzle piece displays mentioned heretofore and many novel features that result in a new puzzle piece displaying apparatus which is not anticipated, rendered obvious, suggested, or even implied by any of the prior art puzzle piece displays, either alone or in any combination thereof.

It is another object of the present invention to provide a new puzzle piece displaying apparatus, which may be easily and efficiently manufactured and marketed.

It is a further object of the present invention to provide a new puzzle piece displaying apparatus, which is of a durable and reliable construction.

An even further object of the present invention is to provide a new puzzle piece displaying apparatus which is susceptible of a low cost of manufacture with regard to both materials and labor, and which accordingly is then susceptible of low prices of sale to the consuming public, thereby making such puzzle piece displaying apparatus economically available to the buying public.

Still yet another object of the present invention is to provide new puzzle piece displaying apparatus which provides in the apparatuses and methods of the prior art some of the advantages thereof, while simultaneously overcoming some of the disadvantages normally associated therewith.

Still another object of the present invention is to provide a new puzzle piece displaying apparatus for displaying a plurality of puzzle pieces for facilitating assembly of the pieces.

Yet another object of the present invention is to provide a new puzzle piece displaying apparatus which includes a pair of upstanding leg assemblies and a rotating assembly for holding a plurality of puzzle pieces. A plurality of plates is for removably securing a plurality of pieces to the plates. A frame supports the plates. The frame includes an end member, a shaft, at least one support member and a plurality of mounting members.

Still yet another object of the present invention is to provide a new puzzle piece displaying apparatus that provides a compact display area for a multitude of puzzle pieces for ease in facilitating the assembly of the puzzle pieces.

Even still another object of the present invention is to provide a new puzzle piece displaying apparatus that permits a three-dimensional device for viewing puzzle pieces while assembling a puzzle, thus eliminating head and neck strain while viewing the unassembled puzzle pieces.

Yet still another object of the present invention is to provide a new puzzle piece displaying apparatus that provides an adhesive type surface for allowing easy transport and movement of the apparatus while assembling the puzzle pieces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
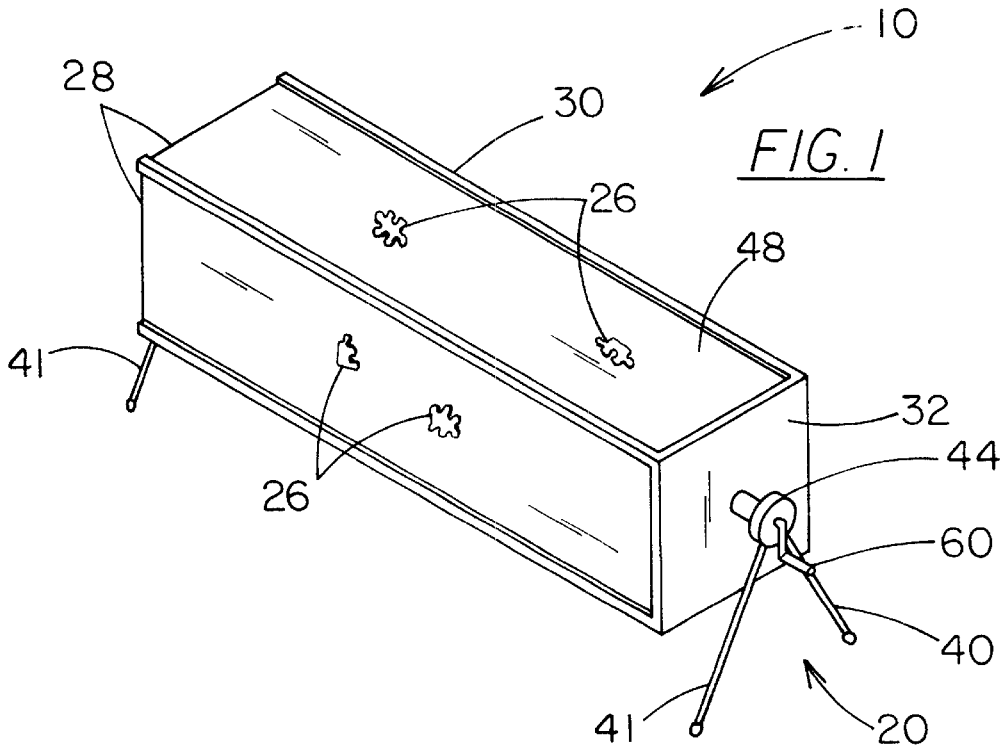
FIG. 1. is a schematic perspective view of a new puzzle piece displaying apparatus according to the present invention.
Figure 2:
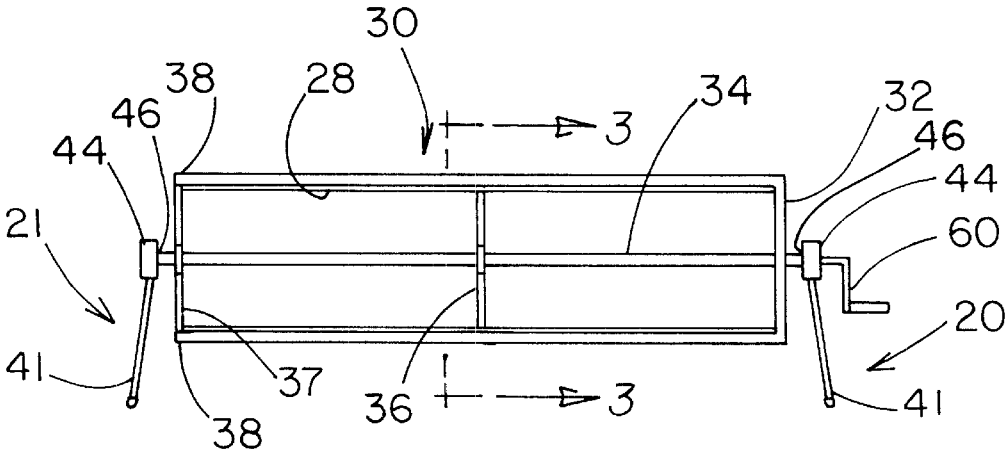
FIG. 2 is a schematic broken away side view of the present invention.
Figure 3:
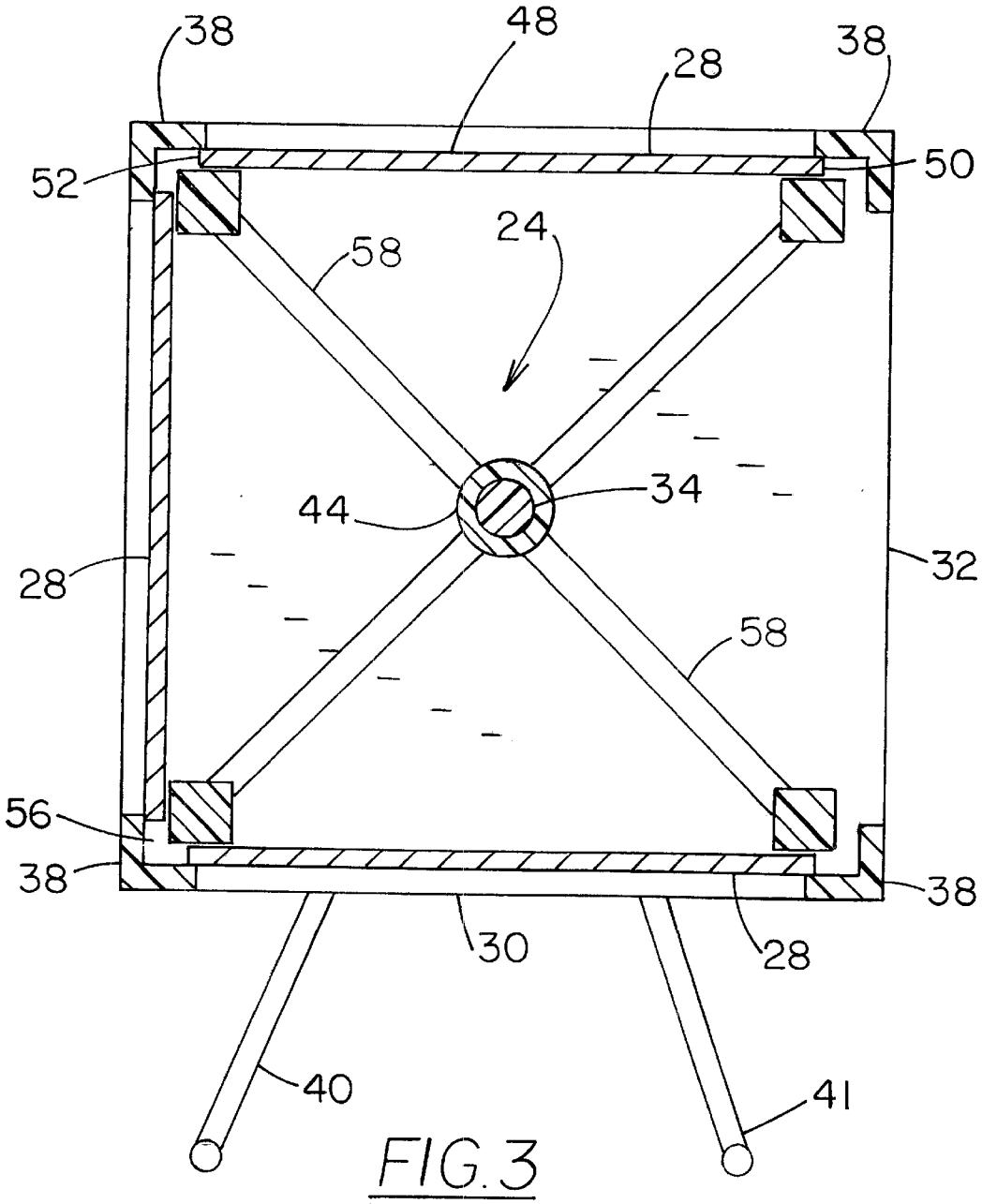
FIG. 3 is a schematic cross-sectional end view of the present invention taken along line 3—3 of FIG. 2.

With reference now to the drawings, and in particular to FIGS. 1 through 3 thereof, a new puzzle piece displaying apparatus embodying the principles and concepts of the present invention and generally designated by the reference numeral 10 will be described.

As best illustrated in FIGS. 1 through 3, the puzzle piece displaying apparatus 10 generally comprises a pair of upstanding leg assemblies 20 and 21 and a rotating assembly 24 for holding a plurality of puzzle pieces 26. The rotating assembly 24 includes a plurality of plates 28 for removably securing a plurality of pieces 26 to the plates. A frame 30 supports the plates 28. The frame 30 includes an end member 32, a shaft 34, at least one support member 36 and a plurality of mounting members 38.

The pair of upstanding leg assemblies 20, 21 are positioned in a spaced relationship. Each of the leg assemblies 20, 21 includes a pair of legs 40, 41 radiating from a central hub 44. The central hub 44 of each of the leg assemblies 20, 21 includes an opening 46 therein.

A rotating assembly 24 is provided for holding a plurality of pieces 26. The rotating assembly 24 comprises a plurality of plates 28 for removably securing a plurality of pieces 26 thereon. Each of the plates 28 includes an outer surface 48. The outer surface 48 preferably includes a suitable adhesive applied thereon for releasably holding pieces 26 on the outer surface, 48 of the plates 28. Preferably, the adhesive is strong enough to hold the pieces 26 when the outer surface 48 of each plate 28 faces downward, but is not aggressive enough to damage pieced 26 when they are removed. Each of the plates 28 includes opposite and parallel side edges 50, 52.

A frame 30 is provided for supporting the plates 28. The frame 30 includes an end member 32. The end member 32 is positioned adjacent to one of the leg assemblies 20 or 21. Preferably, the end member 32 has a rectangular shape. A shaft 34 is provided to extend from a central location on the end member 32.

At least one support member 36 is positioned parallel to the end plate. The support member 36 is mounted on the shaft 34. Preferably, additional support member 37 is provided at an end of the rotating assembly 24 opposite to the end member 32. Thus, the support member 36 is a central support member and the support members 37 is an end support member.

A plurality of mounting members 38 extends from the end member 32 to the support member 36 or 37. A pair of the mounting members 38 is oriented substantially parallel to each other. Each one of the pair of mounting members 38 includes a slot 56 formed therein. The slot 56 of each mounting member 38 is formed in an opposed relationship to the slot 56 in the other of the pair of mounting members 38 in a manner permitting sliding insertion of one of the plates 28 in a slot 56 of the pair of mounting members 38. The plurality of mounting members 38 may preferably comprise four mounting members 38, each being positioned at a corner of a rectangular shape. Each of the plates 28 may then be inserted in each of the slots 56 of the mounting members 38 to form a box structure with the end member 32.

The support member 36 has a plurality of arms 58. Each of the arms 58 includes a mounting member 38 mounted thereon. Each support member 36 preferably includes four arms 58.

A crank 60 is mounted on an end of the shaft 34 for rotating the rotating assembly 24. The crank 60 is located adjacent to one of the leg assemblies 20. The shaft 34 passes through the opening 46 in the hub 44 of one of the leg assemblies 20 or 21.

In use, the puzzle pieces are placed on each of the plurality of plates and affixed using the adhesive surface on the plates. Then, the plates are each removably secured to a frame for supporting the plates. The user turns the crank in the apparatus, thus causing the plurality of plates to rotate and allowing the user to view a multitude of puzzle pieces in a small compact area. The user may simply pull the desired puzzle piece off of the appropriate panel.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An apparatus for displaying a plurality of pieces of a puzzle for facilitating assembly of the pieces, the apparatus comprising:

a pair of upstanding leg assemblies in spaced relationship, each of the leg assemblies having a pair of legs radiating from a central hub, the central hub of each of the leg assemblies having an opening therein; and a rotating assembly for holding a plurality of pieces, the rotating assembly comprising:

a plurality of plates for removably securing a plurality of pieces thereon, each of the plates having an outer surface, an adhesive being applied to the outer surface of each of the plates for releasably holding pieces on the outer surface of the plates, each of the plates having opposite and parallel side edges, wherein the adhesive has cohering characteristics being sufficiently strong enough to hold the pieces to the outer surfaces when either of the plates is oriented upside down while still allowing the pieces to be repetitively removed without damage;

a frame for supporting the plates including an end member, the end member being positioned adjacent to one of the leg assemblies, the end member having a rectangular shape;

a shaft extending from the end member, the shaft extending from a central location on the end member;

at least one support member positioned parallel to the end plate, the support member being mounted on the shaft, wherein the frame includes a pair of support members in spaced relationship, one of the support members being a central support member and one of the support members being an end support member;

a plurality of mounting members extending from the end plate to the support member, a pair of the mounting members being oriented substantially parallel to each other, each of the pair of mounting members having a slot formed therein in an opposed relationship to each other in a manner permitting sliding insertion of one of the plates in the slots of the pair of mounting members, wherein the plurality of mounting members comprises four mounting members positioned at corners of a rectangular shape such that plates inserted in the slots of the mounting members form a box structure with the end member;

wherein the support member has a plurality of arms, each of the arms having a mounting member mounted thereon, the support member having four arms;

wherein each of the plates is longitudinally slidable in the slots such that the plates are selectively positionable in the frame to permit usage of the plates while positioned in the frame or on a flat support surface for various purposes; and a crank mounted on an end of the shaft for rotating the rotating assembly, the crank being located adjacent one of the leg assemblies.

* * * * *